US012213560B2

(12) United States Patent
Bjursten et al.

(10) Patent No.: US 12,213,560 B2
(45) Date of Patent: Feb. 4, 2025

(54) LINER FOR A SKI BOOT AND TONGUE HAVING IMPROVED VENTILATION AND PRESSURE DISTRIBUTION ON A FOOT

(71) Applicant: Cintor AB, Lund (SE)

(72) Inventors: Henrik Bjursten, Lund (SE); Magnus Dencker, Höllviken (SE)

(73) Assignee: Cintor AB, Lund (SE)

( * ) Notice: Subject to any disclaimer, the term of this patent is extended or adjusted under 35 U.S.C. 154(b) by 562 days.

(21) Appl. No.: 17/426,478

(22) PCT Filed: Jan. 30, 2020

(86) PCT No.: PCT/EP2020/052241

§ 371 (c)(1),
(2) Date: Jul. 28, 2021

(87) PCT Pub. No.: WO2020/157174

PCT Pub. Date: Aug. 6, 2020

(65) Prior Publication Data

US 2022/0104576 A1 Apr. 7, 2022

(30) Foreign Application Priority Data

Jan. 30, 2019 (EP) ..... 19154420

(51) Int. Cl.
*A43B 5/04* (2006.01)
*A43B 23/26* (2006.01)

(52) U.S. Cl.
CPC ..... *A43B 5/0405* (2013.01); *A43B 23/26* (2013.01)

(58) Field of Classification Search
CPC ..... A43B 5/0405; A43B 5/047; A43B 5/0482; A43B 23/26
See application file for complete search history.

(56) References Cited

U.S. PATENT DOCUMENTS 1,753,415 A * 4/1930 McKnight ..... A43B 23/26 36/54
3,076,274 A * 2/1963 Schlecht ..... A43B 23/26 36/54

(Continued)

FOREIGN PATENT DOCUMENTS

EP 0370948 A1 5/1990
EP 0468551 A1 1/1992
WO 0033692 A1 6/2000

OTHER PUBLICATIONS

International Search Report dated Jun. 24, 2020; International Application No. PCT/EP2020/052241.

*Primary Examiner* — Sharon M Prange
(74) *Attorney, Agent, or Firm* — DINSMORE & SHOHL LLP

(57) ABSTRACT

A liner for a ski boot has a tongue with an outer substantially saddle-shaped generally stiff layer generally conforming to a dorsal surface of a foot, an inner padding layer contacting the dorsal surface and having a first and second portion. The second portion covers at least a part of a dorsalis pedis artery and is softer than the first portion. A support layer is outside the outer layer and at least partially overlaps the second portion. Also provided is a tongue for footwear having an outer substantially saddle-shaped generally stiff layer conforming to the dorsal surface, an inner padding layer contacting the dorsal surface and having a first and second portion. The second portion covers at least a part of a dorsalis pedis artery and is softer than the first portion. A support layer is outside the outer layer and at least partially overlaps the second portion.

17 Claims, 10 Drawing Sheets

(56) References Cited

U.S. PATENT DOCUMENTS

| | | | | |
|---|---|---|---|---|
| 4,920,666 | A * | 5/1990 | Marega | A43B 1/0018 36/117.3 |
| 5,265,353 | A * | 11/1993 | Marega | A43D 999/00 36/117.6 |
| 5,575,090 | A | 11/1996 | Condini | |
| 6,237,253 | B1 * | 5/2001 | Feuerecker | A43B 23/26 36/117.1 |
| 8,677,654 | B2 * | 3/2014 | Aveni | A43B 23/0215 36/88 |
| 2012/0124863 | A1 * | 5/2012 | Aveni | A43B 23/26 36/50.1 |
| 2013/0312284 | A1 * | 11/2013 | Berend | A43B 23/26 36/83 |
| 2014/0033575 | A1 * | 2/2014 | Cruikshank | A43B 5/1625 36/54 |
| 2015/0313309 | A1 * | 11/2015 | Darden | A43B 3/34 36/119.1 |
| 2016/0007674 | A1 * | 1/2016 | Labonte | A43B 23/26 12/146 C |

* cited by examiner

LINER FOR A SKI BOOT AND TONGUE HAVING IMPROVED VENTILATION AND PRESSURE DISTRIBUTION ON A FOOT

CROSS-REFERENCE TO RELATED APPLICATIONS

This application is the U.S. National Stage of PCT/EP2020/052241 filed Jan. 30, 2020, which claims priority to European Application No. 19154420.4, filed Jan. 30, 2019, the entire content of both are incorporated herein by reference in their entirety.

FIELD OF THE INVENTION

The present disclosure relates to embodiments of a liner for a ski boot, a tongue for a liner of a ski boot and variants of the tongue for footwear having a tongue.

BACKGROUND OF INVENTION

As most skiers would recognize, cold feet and pain could be a problem when wearing ski boots and skiing for a longer time. Although there are a number of known measures to take into consideration, including making sure that the ski boots have a good fit, that socks having a high warmth-to-weight ratio are worn, active heating of the ski boot etc. Nevertheless it is also important for the skiing performance that the ski boot is tightly buckled to give the right support. Tight buckling, however, may increase the risk of blocking blood vessels of the foot, thereby also increasing the risk of getting cold feet.

Many other types of footwear rely to a large extent on a tight fit between the shoe and the foot in order for the footwear to follow the movement of the foot in the best way possible, such that it gives a rapid response when the foot is moved. This is particularly important in footwear such as sports shoes, wherein the ability of a user of the footwear to move the foot faster and with an increased control of the movements, may result in an overall better performance.

The paradox with most types of shoes, especially sport shoes, is that to achieve a good fit and good control over the shoe, the shoe needs to be laced or buckled over the midfoot creating a tight seal between the forefoot and the backfoot. This will create two different climate zones of the foot with a tight seal between. Furthermore, the lacing or buckling typically acts to apply a significant pressure to the dorsal surface of the foot.

Often, a user of the shoe want to buckle of tie the shoe hard such that there is a lower degree of flexibility and that the shoe can follow the foot to a larger extent.

At the same time, using a footwear, and in particular a sports shoe, can act to provide a discomfort to the user due to a significant pressure being applied to the foot. In some cases, such as for ski boots it is common that the liner is individually fitted to a user's foot by for example heat-forming the liner when wearing it for the first time. This results in a footwear which is better adapted to the foot of the user. The resulting pressure, while using the footwear is expected to be more evenly distributed, but many users still feels a significant discomfort, especially when wearing the footwear for an extended amount of time.

Another common drawback with many types of footwear is the lack of sufficient ventilation. While leisure summer shoes may be fabricated in light materials for increased breathing, footwear wherein support for the foot, insulation for warmth, or rigid layers for strength are desired, such as for ski boots, hiking boots or work boots, the ventilation is often not sufficient. As a consequence, perspiration of the foot leads to sweat that cannot be transported away at an adequate rate.

Thereby, there is a significant need for comfortable footwear that can maintain a normal temperature of the foot of a user while the footwear simultaneously offers good control and support.

SUMMARY OF INVENTION

The present inventors have realized that a user does not have to choose between comfort of the foot and control of the footwear. Typically, parts of a footwear for contacting the dorsal surface of the foot, have substantially the same softness. Contrary, the present inventors have discovered that there are significant benefits, in terms of increased control and comfort to the foot, by the use of parts, such as layers, having differing softness.

For example, by arranging softer parts of a footwear (e.g. softer parts of an inner lining of parts of the footwear) such that they are to contact the center part of the dorsal surface of a foot, preferably were important blood vessels, such as the dorsalis pedis artery (dorsal pedal artery) and/or vein, are near the skin, the pressure on these blood vessels may be decreased. Thereby, normal blood flow of the foot can be maintained, acting to both provide oxygen for normal function of the foot and to uphold thermoregulation. In addition, the deep peroneal nerve is located near the dorsal surface of the foot, and reducing the pressure on this nerve can lead to less nerve pain.

Furthermore, softer layers may be arranged such that a user has an increased control over the footwear. By arranging the softer layers such that they are to contact the center of the dorsal surface of a foot, such as along an anterior-posterior axis at the center of the foot, the forces acting on the foot, when using said footwear, is towards the center of the foot, along the anterior-posterior axis. Thereby the foot can be restrained from movement in the coronal plane more efficiently, as compared to normal footwear without a softer layer arranged in such a way. Normal footwear typically has a resulting force acting on the foot, that is downward. Thereby, a significant force is required in order to restrain the foot from movement in the coronal plane. A footwear wherein comprising softer layers arranged such as to contact the center of the foot, along an anterior-posterior axis, offers retainment of the foot in the coronal plane, without the requirement of a significant force acting on the foot.

Yet further, the softer layer may be configured for increased airflow, such as being provided in a material of high air permeability or by being provided as a cavity. By providing the softer layer in a material with high air permeability, or as a cavity, the softer layer further leads to upholding a normal temperature of the foot of a user. Warm and humid air, that is typically trapped in the toe region of a traditional footwear, may thereby be transported away through the softer layer.

The softer layer may be configured such that it forms an air passage between a toe region of the foot wear and an outside of the footwear. The softer layer may for example be provided as an air cavity that extends along the tongue of the footwear for forming an air passage between the outside of the footwear and the dorsal surface of the foot/the toe region. The footwear may further be provided with one or more holes through other layers of the footwear, for improved ventilation.

The incorporation of softer layers in a footwear, such as in a tongue, may have significant effects on the structural rigidity of the footwear/tongue. To maintain the structural rigidity, such as to maintain the shape of the footwear when under stress, support layers may be provided that, at least partially, overlap the softer layers.

The present disclosure therefore relates to a liner for a ski boot, said liner comprising a tongue comprising:

a. an outer generally stiff layer, said layer being substantially saddle-shaped and generally conforming to a dorsal surface of a foot;

b. an inner padding layer providing contact to the dorsal surface of the foot, the inner padding layer having at least a first portion and a second portion, wherein the second portion is arranged to cover at least a part of a dorsalis pedis artery on the dorsal surface of the foot, and wherein the second portion is a cavity or provided in a material that is softer than the material of the first portion; and c. a support layer arranged outside the outer generally stiff layer, the support layer at least partially overlapping the second portion of the inner padding layer.

The dorsalis pedis artery is a blood vessel which carries oxygenated blood to the dorsal surface of the foot and the toes. It is a continuation of the anterior tibial artery, starting at the ankle joint and terminates at the proximal part of the intermetatarsal space. From here, it divides into the dorsal metatarsal artery and the deep plantar artery.

When a pressure is applied to the dorsal surface of the foot, and in particular to the dorsalis pedis artery, the blood flow to the foot may be decreased. When a significant pressure is acting on the dorsal surface of the foot, and in particular to the dorsalis pedis artery, the blood supply to the foot through the dorsalis pedis artery may be substantially prevented. The decrease in blood flow to the foot may result in a significant discomfort to the user, a discomfort that may increase over time.

In a preferred embodiment of the present disclosure, the tongue of a footwear is configured to contact the dorsal surface of the foot in such a way as to minimally deform and compress the dorsalis pedis artery while maintaining a good stability of the foot. A basis for maintaining a fully functional blood flow to the foot at the dorsal surface of the foot, may for example be to decrease the pressure applied to, at least a part of, dorsalis pedis artery.

In a preferred embodiment of the present disclosure, the second portion is additionally covering, at least partially, a deep peroneal nerve. This nerve is important for the nervous functions of the foot. The application of pressure to the nerve, and especially in combination with the decrease in blood supply, may result in a discomfort and pain to the user of the footwear. By decreasing the pressure applied to this part of the dorsal surface of the foot, the discomfort related to the pressure applied to the nerve and the restriction of blood flow to the nerve can be decreased, alleviating the user from the discomfort.

The second portion, being softer than the first portion, applies a lower pressure on the contacted dorsal surface of the foot than in comparison with the areas contacted by the first portion. This is a result of the support, in terms of force, between the foot and the liner being substantially attributed to the first portion. By configuring the second portion such that it, at least partially, contacts either the dorsalis pedis artery and/or the deep peroneal nerve, the pressure applied to these areas may be significantly reduced, leading to an increase in the comfort of the user.

Having a softer second portion may increase the likelihood that the tongue collapses due to the large external pressure in a ski boot, or at least that it gets deformed over time. Therefore, in one embodiment of the present disclosure, a support layer is positioned outside the generally stiff layer, which offers structural support to the entire tongue construction of the footwear. This may include flexural rigidity and a low elasticity, such that the overall shape of the tongue is preserved, even though the tongue consists of a second portion of relatively high softness, which would not contribute to the rigidity of the tongue. The support layer may be positioned in such a way as to, at least partially overlap with the second portion. The shape of the support layer may be symmetric or asymmetric, and the area may be small while still offering relatively large structural support. This may include the use of elongated support structures spanning across the area of the second portion. Further, the support layer can include a single structure per tongue, or multiple ones.

In an embodiment of the present disclosure, the second portion is configured in such a way as to apply a lower pressure, to the dorsal surface of the foot, along an anterior-posterior axis of the dorsal surface. The pressure distribution of such an arrangement may lead to an increase in the pressure applied to the sides of the dorsal surface, along the anterior-posterior axis. This may result in a better planar stability of the foot where there is a decrease in the side-movement of the foot. For a footwear such as a ski boot, this is highly desirable as the movement in skiing is to a considerable large extent sideways.

The present disclosure further relates to a tongue for a footwear comprising:

d. an outer generally stiff layer, said layer being substantially saddle-shaped and generally conforming to a dorsal surface of a foot;

e. an inner padding layer providing contact to the dorsal surface of the foot, the inner padding layer having at least a first portion and a second portion, wherein the second portion is arranged to cover at least a part of a dorsalis pedis artery on the dorsal surface of the foot, and wherein the second portion is softer than the first portion; and f. a support layer arranged outside the outer generally stiff layer, the support layer at least partially overlapping the second portion of the inner padding layer.

The tongue may be any embodiment of the tongue as described in relation to the liner for a ski boot and the tongue may be used for other purposes than ski boots, for example sport shoes with high requirements on stability and tightness.

The present disclosure further relates to a liner for a ski boot is disclosed, said liner comprising a tongue comprising:

an outer generally stiff layer, said layer being substantially saddle-shaped and generally conforming to a dorsal surface of a foot;

an inner padding layer providing contact to the dorsal surface of the foot, the inner padding layer having at least a first portion and a second portion, wherein the second portion is arranged to cover at least a part of a dorsalis pedis artery on the dorsal surface of the foot, and wherein the second portion is softer than the first portion, and wherein the outer generally stiff layer has a thickness of at least 3 mm, more preferably 4 mm, even more preferably, 5 mm, most preferably 10 mm, over an area covering the second portion. The relatively thick outer generally stiff layer of the tongue may counteract the weakness of the second portion.

DETAILED DESCRIPTION OF THE INVENTION

Figure 1:
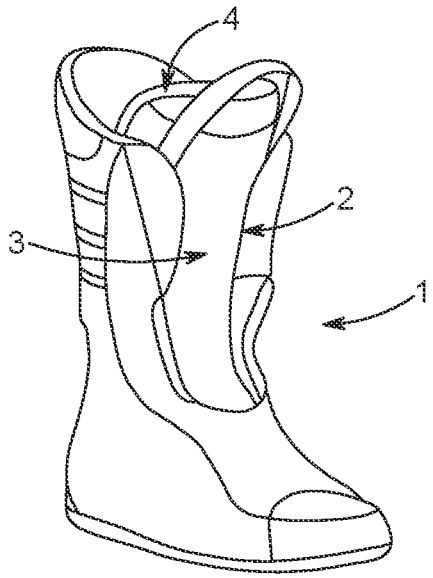
FIG. 1 shows a liner of a ski boot, for receiving a foot, according to an embodiment of the present disclosure.

The present disclosure relates to a liner for a ski boot, said liner comprising a tongue comprising an outer generally stiff layer, said layer being substantially saddle-shaped and generally conforming to a dorsal surface of a foot and optionally also the parts of a lower leg, such as the anterior parts of a lower leg. The stiff layer of the liner in general provide the overall shape of the tongue. It is a relatively rigid construction, with a relatively small flexibility, in order for a more efficient energy transfer between the skier and the ski boot, and further, the edge of the ski.

Preferably there is an inner padding between the foot, and optionally parts of the lower leg, such as the anterior parts of a lower leg, and the generally stiff layer. Additionally this inner padding may comprise a lining, such as a felt fabric, which makes contact with the foot. Thereby, the first portion and/or the second portion may comprise a lining for contacting the foot. The lining may be configured for providing comfort and/or temperature control to the foot, while it in general does not provide any substantial amount of fit and support to the foot. The inner padding, on the other hand, is preferably generally made of foamed materials and provide insulation and cushioning and to a certain extent, it also provides support to the foot. In a preferred embodiment of the present disclosure, the inner padding layer has at least a first portion and a second portion, wherein the second portion is softer than the first portion. The material used for the inner padding layer is most commonly synthetic foam materials. The differences in softness may be provided by the use of different materials within the inner padding layer or by having a foamed material with different foaming properties, such as having a different material-to-cavity fraction. Additionally, the thicknesses of the portion may be different, such that the first portion may be thicker than the second portion. The positioning, and configurations, of said portions being such that they cover different parts of the foot, and optionally also the lower part of the leg. Preferably, the second portion, is general softer than the first portion and at least partially covers the dorsalis pedis artery on the dorsal surface of the foot. In an embodiment of the present disclosure the configuration of the first and second portion is such that the parts of the dorsal surface of the foot being covered by the second portion experiences a lower pressure than the parts of the foot being covered by the first portion of the foot. Preferably, the lowered pressure applied by the second portion is a consequence of it being softer than the first portion. However, the lowered pressure must also be considered in connection with the configuration of the first portion, in that the first portion is positioned in such a way as to provide the main pressure to the foot and to avoid compression of the second foot. The first portion can in this embodiment of the present disclosure be seen as a support structure, which due to its less soft structure, provides support in order to withstand further compression of the second portion. The two materials may have different relationships between the applied stress and the strain. As an example, the second portion may have a lower Young's modulus than the first portion resulting in that if both material is compressed an equal distance, which is true at the boundary between the two materials, the resulting pressure applied to the surface of the foot contacting the corresponding area of the respective portion is lower for the second portion than for the first portion. In this way, the pressure distribution within the liner, including the part contacting the dorsal surface of the foot, can be controlled, in order to provide an optimized value for different parts of the liner such in terms of their respective functions and further, in terms of the anatomy of the foot being contacted.

In a preferred embodiment of the present disclosure a support layer is arranged outside the outer generally stiff layer, the support layer at least partially overlaps the second portion of the inner padding layer. The support layer may provide additional rigidity in order to preserve the shape of the tongue, in circumstances such as repetitive stress cycles, and further, at high loads. The use of a second portion, with an increased softness compared to the first portion, may decrease the stability of the shoe, and in particular the tongue. The tongue of the ski boot may be one of the main components for transferring force from the foot to the equipment. As such, its stability and rigidity is of key importance for the performance of a user. Tongues of normal ski boots would not be able to incorporate the addition of a second portion having a higher softness than the first portion, due to the high likeliness of collapsing the liner, and additionally due to the lowered efficiency in energy transfer between the foot and the gear. To prevent this, a preferred embodiment of the present disclosure, incorporates a support layer outside the generally stiff layer for preserving the overall shape of the tongue of the liner. The area of the second portion may, due to its softness, have an increased mechanical stress. As such, it is required that an appropriate reinforcement is incorporated in order to assure that the structure does not deflect enough to interfere with functions of the tongue and that the tongue behaves as intended during different loads.

In an embodiment of the present disclosure, the second portion is configured to, at least partially, contact the dorsal surface of a foot, where the dorsalis pedis artery is near the epidermal layer. The epidermal layer is the outermost of the layers that make up the skin. As such, the position where dorsalis pedis artery is close to the epidermal layer is where this artery is close to the periphery of the body. At this point, the artery is not protected by rigid structures of the body, such as bones, and the application of pressure can cause a significant deformation of this artery. The pressure related to deform the artery is in addition to how near the epidermal layer the artery is position also related to the blood pressure, acting to withstand deformation and overcome any pressure applied to it. A normal blood pressure is often considered to be a systolic pressure of 120 mmHg, corresponding to 0.16 bar or 10700 $N/m^2$ and a diastolic pressure of 80 mmHg, corresponding to approximately 0.11 bar or 16000 $N/m^2$. An applied force on the dorsal surface of the foot acting to be translated into a pressure on the dorsalis pedis artery above 0.16 bar would at least be required in order to completely close of the pressure applied to the foot. Having a configuration of the second portion, such that the pressure on the area of dorsalis pedis artery being lower, preferably considerably lower, than this value would consequently act to retain the function of the artery and, in continuation, the normal function of the foot.

The pressure applied by the second portion, is, in a preferred embodiment, lower than the pressure applied by the first portion on the dorsal surface of the foot. In addition to a smaller amount of pressure applied to the foot, the second portion may provide climate control, comfort and fit. As such, the second portion preferably possesses considerably insulating and elastic properties which can act to provide comfort, better control of the ski boot and additionally more efficient energy transfer from the foot to the ski boot and the edge of the ski.

In yet another embodiment of the present disclosure the second portion is arranged such that a smaller pressure is applied on the dorsal surface, where the deep peroneal nerve is near the epidermal layer, than an average pressure applied by the first portion. Pressure applied to the deep peroneal nerve may result in a significant discomfort to the wearer of the ski boot. The discomfort may be directly related to the pressure acting on the nerves, which may be registered as pain above a certain threshold pressure level. Additionally the discomfort may be related to a numbness, or "tingling" pins-and-needles sensation in the foot, or cramping. The pressure exerted on the nerve may further act to decrease the function of the foot, such as limit the range of motion of the foot, or the toes, or decreasing the strength of the foot exerted by the muscles. The main drive behind the nerve-related discomfort in the foot is due to the loss of sensory nerve function, the symptoms may be related to the pressure applied directly to the deep peroneal nerve, but may also be, or in addition, related to a decrease in the blood flow to the nerves. This may be linked to the pressure applied to the dorsalis pedis artery, but may also, or additionally, be due to pressure applied to smaller blood vessels surrounding the deep peroneal nerve.

In an embodiment of the present disclosure, a liner for a ski boot, said liner comprising a tongue comprising an outer generally stiff layer, said layer being substantially saddle-shaped and generally conforming to the dorsal surface of a foot. Said tongue further comprising an inner padding layer providing contact to the dorsal surface of the foot, wherein the inner padding layer having at least a first portion and a second portion, wherein the second portion, is softer than the first portion and arranged such that it at least partially covers a dorsalis pedis artery and/or a deep peroneal nerve on the dorsal surface of the foot. The outer generally stiff layer having a first part and a second part wherein the second part has a thickness of at least 3 mm, more preferably 4 mm, even more preferably, 5 mm, most preferably 10 mm, over an area covering the second portion. Preferably the first part of the generally stiff layer has a thickness which is lower than the thickness of the second part. The first and second parts of the stiff layer may further be positioned such that the first part substantially covers the sides of the tongue along its anterior-posterior plane. Having the second part of the stiff layer positioned primarily in the center along the same anterior-posterior plane of the tongue. As such, this embodiment of the present disclosure has a variable thickness of the tongue of the liner, wherein the thickness substantially in the center along the anterior-posterior plane of the tongue is generally higher than on the sides.

Liners

The present disclosure relates to a liner for a ski boot, other terms for a liner include inner boot of a ski boot and an inner ski boot, is meant to be positioned within the outer shell of a ski boot, which usually is provided with means for fastening the ski boot, such as buckles and straps. Liners are made to provide thermal insulation, cushioning, comfort and support. The inner boots comprises multiple parts which generally have been sewed or glued together to form the liner. The upper front part is open to allow for entrance of the foot and can be usually be closed by means of laces and/or Velcro straps. A tongue of the liner is generally present. The tongue comprising a generally stiff layer since this part is the one that transfers the force generated by the skier to the shell of the ski boot and further, to the ski. The flexibility between the skier and the tongue of the foot may as a consequence result in a loss of force and/or response time. At the same time, a certain amount of flexibility and softness if required in order for the tongue of the foot to adapt to a foot, and it may additionally provide thermal insulation and cushioning. Alternative designs of ski boots have been shown, but having an inner ski boot comprising a tongue of a generally stiff material provides a far better energy transfer from the foot and/or the lower leg to the ski and to the edge of the ski. Consequently, this design of a ski boot and its corresponding liner, generally referred to as a Cabrio design, is by far the most common.

Dorsalis Pedis Artery

In a preferred embodiment of the present disclosure the second portion at least partially covers the dorsalis pedis artery. The dorsalis pedis artery (dorsal artery of foot, Latin: arteria dorsalis pedis), is a blood vessel of the lower limb that carries oxygenated blood to the dorsal surface of the foot. It is located ⅓ from medial malleolus. It arises at the anterior aspect of the ankle joint and is a continuation of the anterior tibial artery. It terminates at the proximal part of the first intermetatarsal space, where it divides into two branches, the first dorsal metatarsal artery and the deep plantar artery. The dorsalis pedis communicates with the plantar blood supply of the foot through the deep plantar artery. The part where the dorsal pedal artery exits from beneath the extensor hallucis longus tendon and rides over the tarsal, navicular, cuneiform and proximal part of the metatarsal bones is the general area of the dorsal surface of the foot, where upon application of a relatively small amount of pressure the blood flow through dorsalis pedis artery may be decreased, and at moderate to high pressures it may be substantially hindered. The dorsalis pedis artery pulse can be palpated readily lateral to the extensor hallucis longus tendon (or medially to the extensor digitorum longus tendon) on the dorsal surface of the foot, distal to the dorsal most prominence of the navicular bone which serves as a reliable landmark for palpation. It is often examined, by physicians, when assessing whether a given patient has peripheral vascular disease.

Deep Peroneal Nerve

In a preferred embodiment, the second portion at least partially covers the deep peroneal nerve (deep fibular nerve, Latin: nervus peroneus profundus) begins at the bifurcation of the common peroneal nerve between the fibula and upper part of the peroneus longus, passes infero-medially, deep to extensor digitorum longus, to the anterior surface of the interosseous membrane, and comes into relation with the anterior tibial artery above the middle of the leg; it then descends with the artery to the front of the ankle-joint, where it divides into a lateral and a medial terminal branch.

In the leg, the deep peroneal nerve supplies muscular branches to the anterior compartment of extensor muscles in the leg and an articular branch to the ankle-joint. After its bifurcation past the ankle joint, the lateral branch of the deep peroneal nerve innervates the extensor digitorum brevis and the extensor hallucis brevis, while the medial branch goes on to provide cutaneous innervation to the webbing between the first and second digits. Similar to other large arteries and important nerves of the human body, the position of the deep peroneal nerve is closely linked to the position of the dorsalis pedis artery.

The Dorsalis Pedis Vein

The dorsalis pedis vein is a vein that is located parallel to the dorsalis pedis artery and is on of the veins that transport venous blood back from the forefoot.

3-Point Pressure Distribution

By the use of a liner of a ski boot comprising a tongue having a first portion and a second portion, wherein the second portion applies in general a lower pressure on the foot than the pressure applied by the first portion an optimized pressure distribution of the dorsal surface of the foot may be generated. In a preferred embodiment of the present disclosure, the pressure distribution is such that it increases the planar stability of the foot. By having the secondary portion configured to contact the dorsal surface of the foot substantially parallel to an axis going from the anterior part of the foot to the posterior part of the foot substantially through the center of a said surface. By having the secondary portion positioned in this way, in the center of the foot along the anterior-posterior direction, the pressure distribution applied to the foot is significantly modified. The cross section of the tongue of the liner in the coronal plane of the foot can be considered to be an annular sector. As such, the dorsal surface of the foot which contacts the inner padding along this annulus sector will experience a normal force perpendicular to this surface. The forces having a magnitude and a direction, such that the direction of all normal forces of the annulus sector points towards the origin of the annulus sector. The annulus sector can be defined by an angle, $\alpha$, wherein the annulus sector is approximately within the range $-\pi/2$ rad to $\pi/2$ rad, such that $\alpha=0$ is at the center of the annulus sector. For a tongue of a liner of a ski boot consisting of an inner padding having a single softness, the magnitude of the normal forces acting on the dorsal surface of the foot, would be significantly higher at points contacting the tongue at positions closer to $\alpha=0$ rad than points contacting the tongue as positions at higher angles of the annular sector, such as $-\pi/6$ to $\pi/6$ versus the outer sectors $-\pi/2$ to $-\pi/3$ and $\pi/3$ to $\pi/2$. However, by the use of a tongue having multiple degrees of softness, the pressure distribution may be changed. By configuring the second portion such that it contacts the foot within the annulus sector range $-\pi/6$ to $\pi/6$ while the first portion contacts the annulus sector of the cross section of the dorsal surface of the foot in the remaining parts of the annulus sector, such as $-\pi/2$ to $-\pi/6$ and $\pi/6$ to $\pi/2$, a modified pressure distribution acting on the dorsal surface of the foot may be achieved wherein a higher pressure may be applied to the foot in areas where the dorsal surface of the foot is contacted with the first portion, while a smaller pressure may be applied to the foot in areas where the foot is contacted by the second portion. The redistribution of pressures may in this way achieve a planar stabilization of the foot, wherein a larger pressure acting on the dorsal surface comes from the sides, further away from $\alpha=0$ rad than close to $\alpha=0$ rad. In this way a three point pressure system is achieved wherein a summation of the normal force vectors from each half, positive and negative side, of the annulus sector may result in two substantially mirrored vectors which each pointing towards the origin of the annulus sector. This provides a more stable fixation of the foot as the normal forces decrease the movement of the foot in the coronal and transverse plane.

In a preferred embodiment of the present disclosure, the support layer is configured such that it does not cover the entire annulus sector of the cross section of the tongue of a liner. Preferably the tongue is configured such that the annulus sector is covered with a support layer between $-5\pi/12$ and $5\pi/12$, more preferably between $-\pi/3$ and $\pi/3$, even more preferably between $-\pi/4$ and $\pi/4$, most preferably between $\pi/6$ and $\pi/6$.

By having a support layer which only covers a part of its cross section along an anterior-posterior axis, the tongue is better able to adapt to the shape of the footwear.

Material Properties

The liner is the removable inner boot of a ski boot. It is usually made of foams, leather, textiles and injected plastic components. It provides padding for the foot to protect it from the rigid plastic of the shell. Race boots have minimal padding, using firm materials such as cork, in order to give the athlete instantaneous "on/off" connection to the boot shell and thus the ski. At the other end of the spectrum, comfort/"sport" level boots may have deeply cushioned liners; they may as a consequence offer additional comfort to the foot, but usually offer a decreased amount of communication between the foot and the shell of the ski boot.

The tongue of the liner is, as discussed in earlier sections, often the most important part for efficient transfer of a force from the foot to the shell of the ski boot, and further to the edge of the ski. In order to acquire a more rapid response, without the loss of energy, a more rigid tongue is preferred. However, a downside with a more rigid tongue may include that the comfort is decreased. The ability to adapt to the profile of the foot may decrease with an increased rigidity of the tongue.

The materials of the different parts of the liner, and especially the tongue of the liner, may be chosen such that their functions are optimized. This may further depend on the type of shoe, if it is a ski boot intended for racing, or a shoe wherein comfort is more desired. However, in general the tongue of the liner of a ski boot typically comprises a generally stiff layer having a shape which substantially conforms to the dorsal surface of a foot. The generally stiff layer is often the main component in preserving the shape of the tongue, and further, to efficiently transfer the energy from the foot to the ski. Due to the stiffness of the generally stiff layer, there is often a desire to have an inner padding for adapting to the shape of the foot, and provide a higher degree of comfort. The inner padding may additionally have a thin liner, such as a felt fabric, which contacts the foot instead of the inner padding, acting to provide increased comfort and moisture absorption.

Common tongue of liners on the market today typically consist of generally stiff layers having a substantially continuous thickness of 2 mm. Common materials for this layers include acrylonitrile butadiene styrene (ABS) or low-density polyethylene (LDPE), Ski boots having other materials are less frequent, but they may additionally or instead include other types of polymers, such as nylon, polyethylene, ethylene-vinyl acetate (EVA), high-density polyethylene (HDPE), polystyrene (PS), polyolefin or other polymers.

By having a portion of the inner padding in a softer material, such as the second portion, the structural rigidity of the tongue is decreased. As such, a tongue may require additional reinforcements in order to prevent structural failure. The resistance to deformation of also the generally stiff layer may be decreased when a second portion of increased softness is used. Different means for ensuring the structural rigidity of the tongue of the liner may be used, and may also be used simultaneously.

Having a support layer outside the generally stiff layer can act to maintain the structural rigidity of the tongue also when a second portion, having an increased softness is used. The configuration of the support layer may be such that it at least partially covers the second portion of the inner padding of the tongue. The support layer may be a metal composition or a single substance, such as spring steel sheet, wherein the thickness is at least 0.5 mm. Alternatively, the support layer may comprise a polymer such as Kevlar or glass fiber or another synthetic material. It may also be a composition of multiple materials, chosen such that the support layer has a significant stiffness compared to the generally stiff layer and especially the inner padding layers.

An alternative approach for maintaining the structural rigidity of the tongue may be to increase the thickness of the generally stiff layer. A thicker generally stiff layer can be made of the same materials as a traditional but still have an increased structural rigidity. Analysis using finite-element-analysis (FEA) have shown that for relevant pressure acting on the tongue, an increase of the generally stiff layer to 5 mm may be sufficient in order to prevent structural failure of the tongue during use.

A third alternative to preserving the shape of the tongue may be to have a generally stiff layer composed of alternative materials, which have an increased stiffness. The materials may include metals and polymers, chosen such that the generally stiff layer provides a significant stiffness.

The first portion of the inner padding of the tongue may be made of ethylene-vinyl acetate (EVA) and/or low-density polyethylene (LDPE) and/or high-density polyethylene (HDPE) or other ethylene materials, such as expanded ethylene, or composites thereof. The stiffness of these materials is to a large extent affected by the ratio of the material-to-void ratio which is decided upon fabrication of the foam. A larger fraction of voids within the foam generally results in a softer final material. As such the softness of a final foam material can be tuned within a range. The second portion may consequently comprise the same materials as the first portion, but may have a difference in the properties of the foam, such as a lower material-to-void ratio. Further, the second portion may be of a smaller thickness than the first portion, such that a compression of the first portion is required before the area of the second portion and the dorsal surface of the foot makes contact.

Ethylene vinyl acetate (EVA) is the copolymer of ethylene and vinyl acetate. It's an extremely elastic material that can be sintered to form a porous material similar to rubber, yet with excellent toughness. The porous elastomeric material is in general three times as flexible as low-density polyethylene (LDPE), showing tensile elongation of 750% with a peak melting temperature of 250° F. (96° C.). This flexible porous plastic material has good barrier properties, low-temperature toughness, stress-crack resistance, hot-melt adhesive waterproof properties, and resistance to ultraviolet radiation. Porous EVA may have little or no odor and is in general competitive with rubber and vinyl products in many electrical applications.

Thermoregulation

As previously described, an important aspect of the present disclosure is to maintain a normal temperature of a foot when using the footwear. The temperature of a foot may deviate from the normal temperature due to a lack of blood supply to the foot, such that thermoregulation cannot be uphold. Typically, blood acts to uphold a homeostatic temperature of the foot by providing blood with a normal body temperature, while transporting away warmer of colder blood. In this way, blood acts to even out the temperature within the body. When the blood flow is restricted, this process is decreased and temperature variations within the body may increase.

A common drawback with footwear, such as those that require good control, support, or structural rigidity, such as sports shoes, ski boots or work shoes, is that a large for is exerted on the surface of the foot, such as the dorsalis surface, when in use. A common drawback with the tight fit and large pressure applied to the foot is a decrease in the blood flow and thereby a decrease in the thermoregulation of the foot.

By providing parts of a tongue of a footwear, such as a liner, in softer material, or as a cavity, thermoregulation may be improved. The softer material, or cavity, such as a second portion of an inner padding, may be arranged such that it allows increased blood flow, such as normal blood flow, to the foot. Furthermore, the softer material, or cavity, such as a second portion of an inner padding, may be arranged to provide increased ventilation to the foot, such as between a toe region of the footwear and the outside of the footwear.

Anatomical Planes

Planes as defined herein refers to anatomical planes that is hypothetical planes used to transect the body, in order to describe the location of structures or the direction of movements. In human and animal anatomy, three principal planes are used:

The sagittal plane or median plane (longitudinal, antero-posterior) is a plane parallel to the sagittal suture. It divides the body into left and right.

The coronal plane or frontal plane (vertical) divides the body into dorsal and ventral (back and front, or posterior and anterior) portions. This corresponds to a plane perpendicular to the anterior-posterior axis of a foot/tongue of a footwear and the terms are used interchangeably herein.

The transverse plane or axial plane (lateral, horizontal) divides the body into cranial and caudal (head and tail) portions.

DETAILED DESCRIPTION OF DRAWINGS

The invention will in the following be described in greater detail with reference to the accompanying drawings. The drawings are exemplary and are intended to illustrate some of the features of the presently disclosed tongue of a liner for a ski boot or other footwear, and are not to be construed as limiting to the presently disclosed invention.

FIG. 1 shows a liner (1) of a ski boot for receiving a foot according to an embodiment of the present disclosure. The liner has a tongue (2) wherein said tongue comprises of a generally stiff layer (3) and an inner padding having a first portion (4) and a second portion. The liner may be equipped with means for closure of said liner, such as laces or Velcro straps. The liner comprises different materials which are chosen according to their specific purpose, such as more rigid material generally constitute the outer layers of the liner for providing a structural stability while the inner layers, closer to the foot, in generally are softer, such that they provide comfort to said foot.

Figure 2:
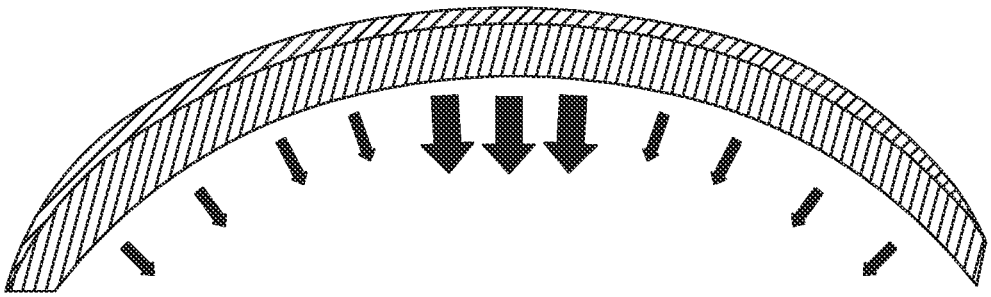
FIG. 2 PRIOR ART
FIG. 2 shows a cross section of a tongue of a liner along a plane perpendicular to the anterior-posterior axis of the tongue, according to the prior art.

FIG. 2 shows a tongue of a liner for a ski boot according to prior art. The pressure applied to a dorsal surface of a foot is typically substantially higher in the center parts of the cross section than in the peripheral parts of the cross section. This may result in a discomfort to a user of the liner, as the pressure distribution is significantly non-uniform, and additionally a significant pressure may be applied to areas of the dorsal surface of the foot such that the blood flow through major blood vessels and the function of major nerves are affected.

Figure 3:
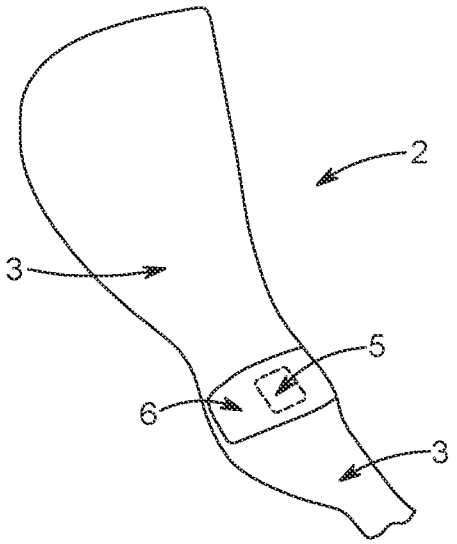
FIG. 3 shows a tongue of a liner, having a first portion and a second portion (5) together with a generally stiff layer (3) and a support layer (6), according to an embodiment of the present disclosure.

FIG. 3 shows a tongue of a liner having an inner padding layer with a first portion and a second portion (5) together with an outer generally stiff layer (3) and a support layer (6) according to an embodiment of the present disclosure. By the use of a first portion and a second portion, wherein the second portion is softer than the first portion, the structural integrity of the tongue of the liner may be compromised. The use of a support layer, wherein the support layer at least partially covers the second portion, may act to preserve the overall shape of the tongue, even at pressures relevant for its use. The inner padding of the tongue, or the entire tongue, may be lined with a felt fabric for providing increased comfort.

Figure 4:
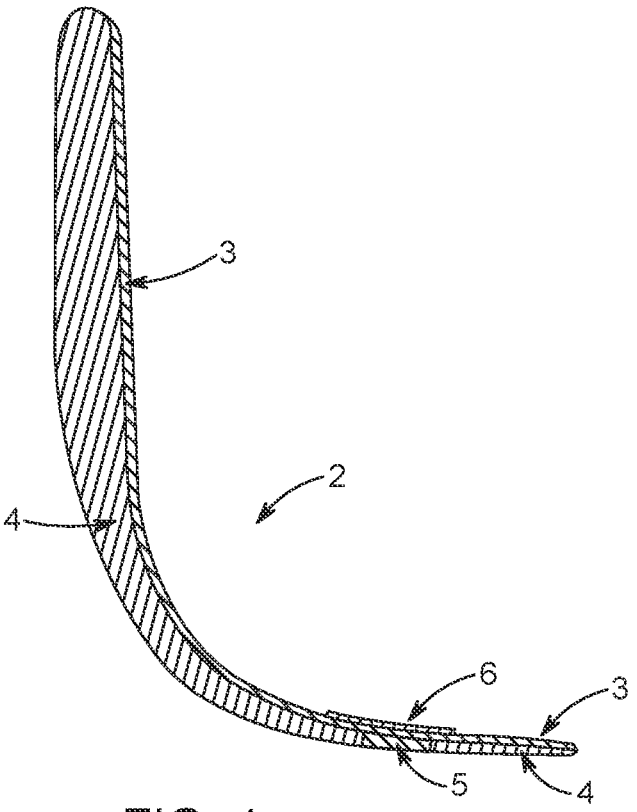
FIG. 4 shows a cross section along a plane parallel to the anterior-posterior axis of the tongue of a ski boot, according to an embodiment of the present disclosure.

FIG. 4 shows a cross section along a plane parallel to the anterior-posterior axis of the tongue of a ski boot, according to an embodiment of the present disclosure. The first portion (4) is configured to contact the dorsal surface of a foot, and may additionally also contact the lower part of a leg. It may be covered in a liner, such as a felt fabric. The first portion act to provide the main support between the foot and the generally stiff layer (3). The second portion (5) is configured such that it is softer than the first portion, additionally it may provide climate control, comfort and fit. The second portion is positioned such that it at least partially covers a dorsalis pedis artery, such as the area where dorsalis pedis artery is close to the epidermal layer of the dorsal surface of the foot. Preferably, the second portion is configured such that the pressure applied to the dorsal surface of the foot which it contacts, is significantly lower than the general pressure applied by the first portion. Thereby the pressure exerted on said artery may be decreased, and its normal function maintain, at the same time as the efficiency in energy transfer and the response time of the ski boot is maintained, as this is to a significant degree related to the stiffness of the tongue of the liner of the ski boot.

Figure 5:
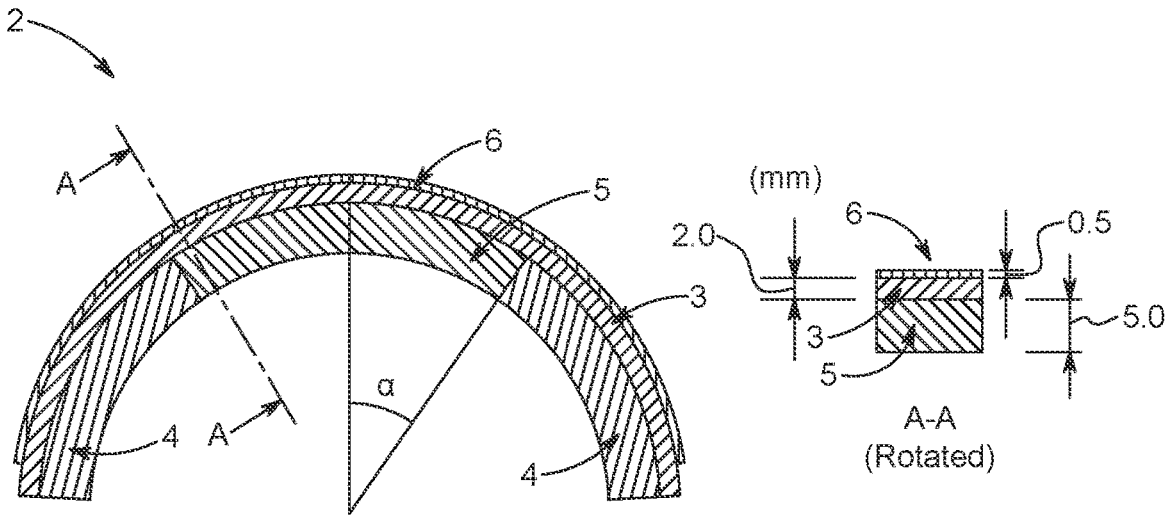
FIG. 5 shows a cross section of a tongue of a liner along a plane perpendicular to the anterior-posterior axis of the tongue of a ski boot, having a support structure (6) covering, at least partially, the second portion (5), according to an embodiment of the present disclosure.

FIG. 5 shows a cross section of a tongue of a liner along a plane perpendicular to the anterior-posterior axis of the tongue of a ski boot, having a support structure (6) covering, at least partially, the second portion (5) according to an embodiment of the present disclosure. The first and second portion of the inner padding are configured such that the second portion at least partially contacts with the area of the dorsal surface of the foot where dorsalis pedis artery is near the epidermal layer. Having the second portion positioned within the annulus sector which is the cross section of the tongue such that it ranges between two values, such as $-\pi/6$ and $\pi/6$ rad, while the first portion is configured to cover the remaining range of the tongue, such as $-\pi/2$ to $-\pi/6$ and $\pi/6$ to $-\pi/2$ rad. In order to preserve the overall shape of the tongue, while still allowing for the second portion having a significant softness, a support layer (6) is used consisting of a rigid material, such as steel, having a thickness of for example 0.5 mm.

Figure 6:
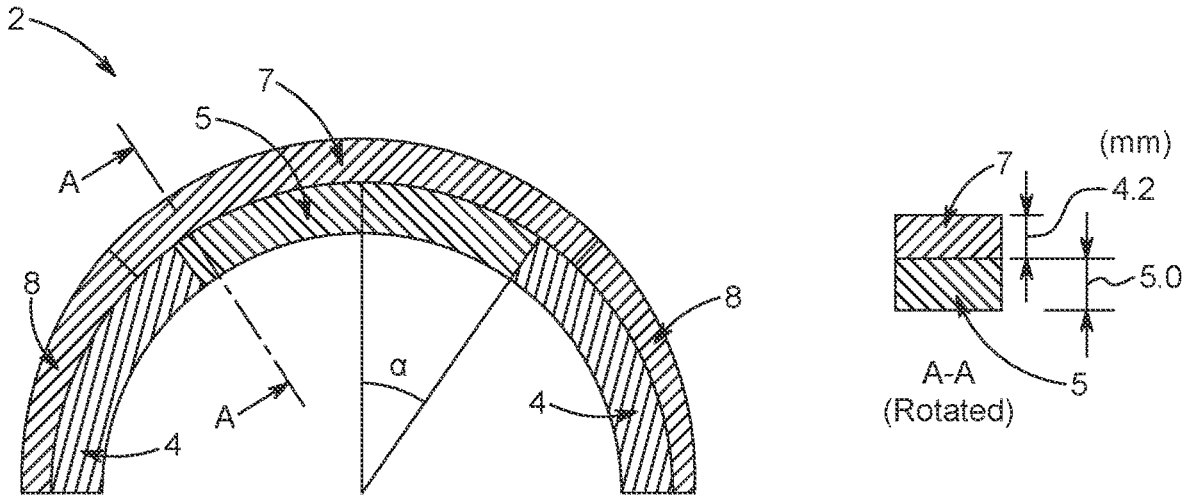
FIG. 6 shows a cross section of a tongue of a liner along a plane perpendicular to the anterior-posterior axis of the tongue of a ski boot, wherein the generally stiff layer comprises a first section (8) and a second section (7) according to an embodiment of the present disclosure.

FIG. 6 shows a cross section of a tongue of a liner along a plane perpendicular to the anterior-posterior axis of the tongue of a ski boot, wherein the generally stiff layer comprises a first part (8) and a second part (7) The second part of the generally stiff layer has a thickness of 5 mm in the example. A first central part (8) of the outer generally stiff layer (3) has a thickness of 4.2 mm in the region coinciding with the second portion (5) and may be thinner in the second part (7).

Figure 7:
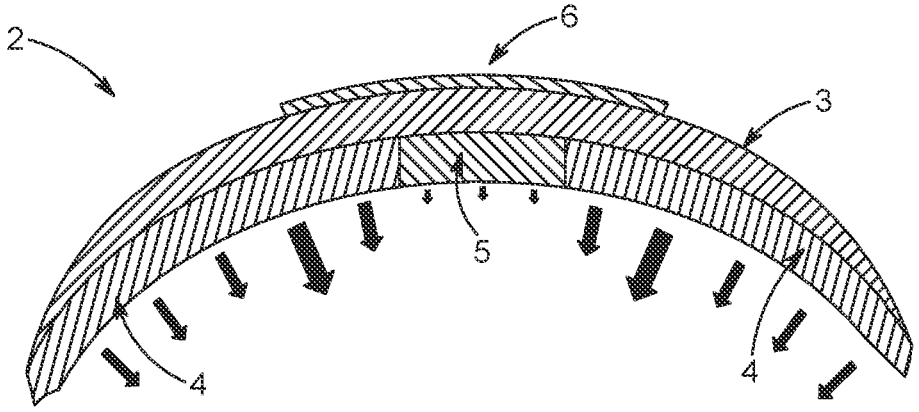
FIG. 7 shows a cross section of a tongue of a liner along a plane perpendicular to the anterior-posterior axis of the tongue of a ski boot, wherein the pressure exerted on the dorsal surface of a foot by the second portion is significantly lower than the pressure applied by the first portion according to an embodiment of the present disclosure.

FIG. 7 shows a cross section of a tongue of a liner along a plane perpendicular to the anterior-posterior axis of the tongue of a ski boot, wherein the pressure exerted on the dorsal surface of a foot by the second portion is significantly lower than the pressure applied by the first portion according to an embodiment of the present disclosure. The resulting pressure distribution on the dorsal surface of a foot is substantially non-uniform in such a way as the pressure applied by the first portion is, in general, higher than the pressure applied by the second portion. The resulting pressure components along the dexter-sinister axis of the tongue, from each quarter annulus of the tongue are mirrored and significantly larger than if the inner padding only had a first portion. The resulting pressure distribution leads to a larger planar stability on the foot wherein more pressure is applied to the sides of the foot.

Figure 8:
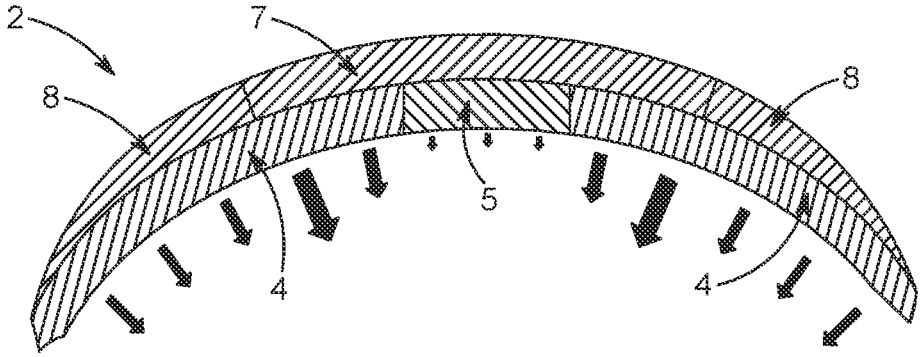
FIG. 8 shows a cross section of a tongue of a liner along a plane perpendicular to the anterior-posterior axis of the tongue of a ski boot, wherein the pressure exerted on the dorsal surface of a foot by the second portion is significantly lower than the pressure applied by the first portion according to an embodiment of the present disclosure.

FIG. 8 shows a cross section of a tongue of a liner along a plane perpendicular to the anterior-posterior axis of the tongue of a ski boot, wherein the pressure exerted on the dorsal surface of a foot by the second portion is significantly lower than the pressure applied by the first portion according to an embodiment of the present disclosure. The stiff layer having a second part (7) with a thickness of at least 4 mm, more preferably 5 mm, most preferably 6 mm, compensates for the implementation of a second portion (5). The pressure distribution applied to the dorsal surface of the foot from each quarter annulus of the tongue is thereby higher along the dexter-sinister axis than for a tongue having only a the first portion, resulting in an increased planar stability of the foot.

Figure 9:
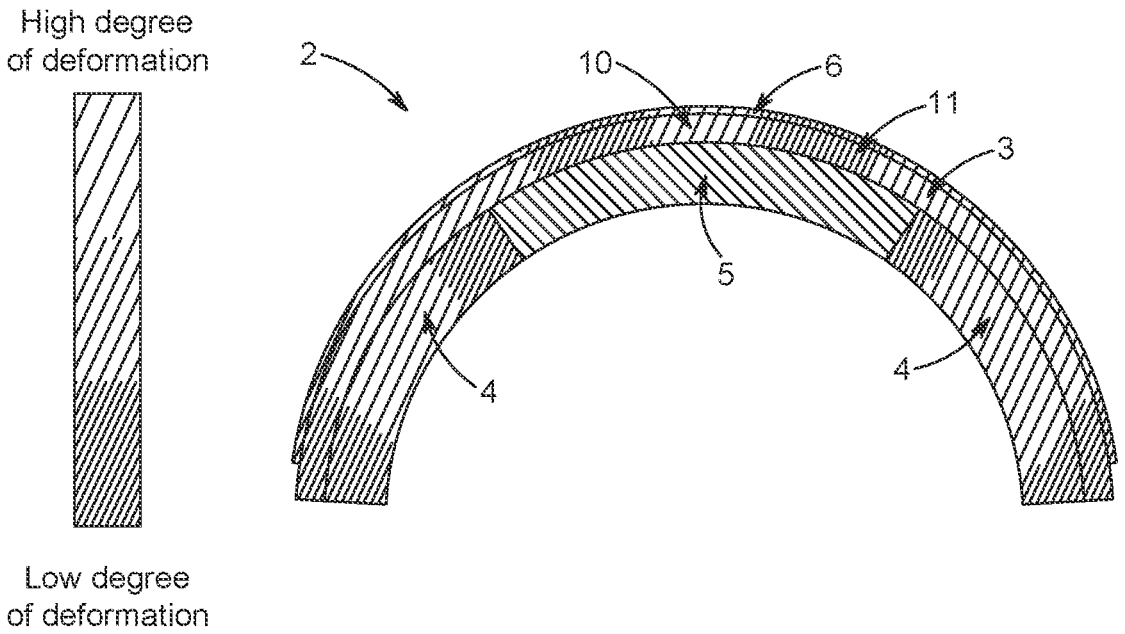
FIG. 9 shows how the cross section of a tongue of a liner along a plane perpendicular to the anterior-posterior axis of the tongue of a ski boot is deformed when the ski boot is buckled, according to an embodiment of the present disclosure.

FIG. 9 shows how the cross section of a tongue of a liner along a plane perpendicular to the anterior-posterior axis of the tongue of a ski boot is deformed when the ski boot is buckled, according to an embodiment of the present disclosure. Finite element analysis (FEA) of a CAD model have been carried out showing the structural rigidity of the tongue of a liner, wherein the deformation of the tongue is measured. By the use of a support structure (6), the deformation is limited, even within high stress levels for normal use. The resulting deformation here ranges from 0 mm for the lowest stress levels, measured mainly at the high angle parts of the annulus sector, and 0.08 mm, measured mainly at the low angle parts of the annulus sector, which is around a factor 30 lower than what was measured in the model not having a support structure.

Figure 10:
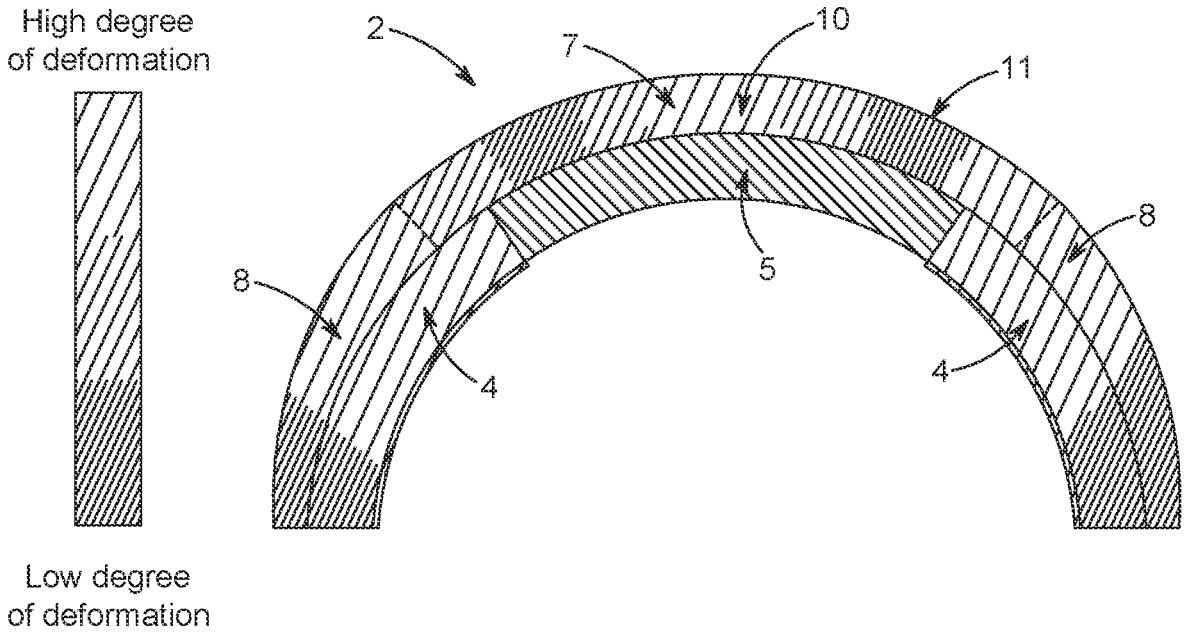
FIG. 10 shows how the cross section of a tongue of a liner along a plane perpendicular to the anterior-posterior axis of the tongue of a ski boot is deformed when the ski boot is buckled, according to an embodiment of the present disclosure.

FIG. 10 shows how the cross section of a tongue of a liner along a plane perpendicular to the anterior-posterior axis of the tongue of a ski boot is deformed when the ski boot is buckled, according to an embodiment of the present disclosure. The generally stiff layer has a first part (7) and a second part (8), wherein the second part (8) has a thickness of at least 4 mm, more preferably 5 mm, most preferably 6 mm, such that the rigidity of the tongue is increased. FEA modelling of a CAD design with a maximum thickness of the second part of the generally stiff layer of 5 mm at $\alpha=0$ rad of the annulus was carried out, resulting in a substantially small deformation of the tongue. The maximum displacement, acquired mainly at the low angle sector of the annulus, was 0.59 mm. Consequently, increasing the thickness of this specific layer may allow for the compensation of the loss in structural integrity due to the implementation of the second portion having a significant softness.

Figure 11:
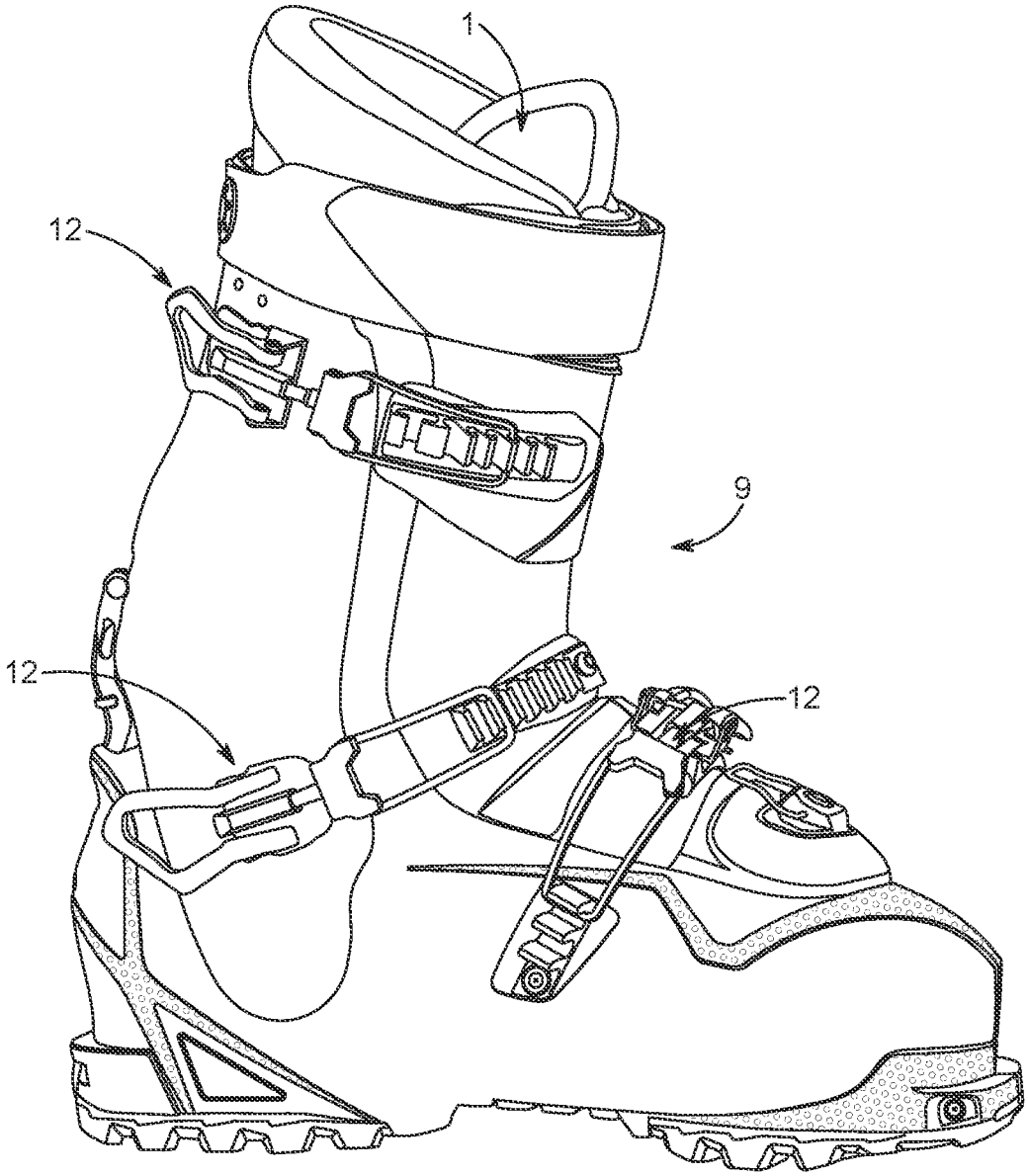
FIG. 11 shows a ski boot with a liner according to an embodiment of the present disclosure.

FIG. 11 shows a ski boot (9) with a liner (1), according to an embodiment of the present disclosure. The ski boot has means for closure, such as buckles (12), and Velcro straps. The ski boot is designed such that it fits into a ski binding mounted on a ski. The pressure exerted on the dorsal surface of the foot can to some extent be varied by adjusting the closure of the ski boot, such as a harder buckling resulting in a larger pressure being applied to the dorsal surface of the foot. This may be desired as a larger pressure applied to the dorsal surface of the foot results in a better transfer of energy between the foot and the ski boot, and further, the edge of the ski. At the same time, increasing the force applied to the dorsal surface of the foot also increases the discomfort of a user, especially in the longer time scale, as arteries of the foot may be hindered, and further, a significant pressure may be applied to nerves, and their surrounding blood vessels, acting to impede on the functions of the nerves.

Figure 12:
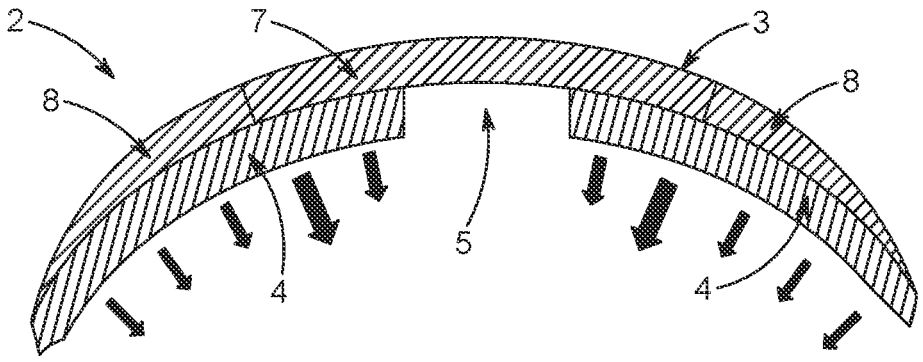
FIG. 12 shows a cross section of a tongue of a footwear, along a plane perpendicular to the anterior-posterior axis of the tongue, wherein the second portion is provided as a cavity.

FIG. 12 shows a cross section of a tongue (2) of a footwear, along the coronal plane, wherein the second portion (5) is provided as a cavity. The cavity may act to increase the ventilation of the footwear. By arranging the cavity such that it extends towards the outside of the footwear, an air passage (i.e. an air canal or ventilation canal) between the footwear and the outside may be provide, for increased ventilation. Furthermore, by the use of a cavity, the pressure acting on the dorsal surface of a foot, when in use, may be even lower than that applied to the surface by a second portion of an inner padding layer in a soft material. The cavity is formed in the second portion of the inner padding layer and thereby extends, in the coronal plane, towards the outer generally stiff layer (3).

Figure 13:
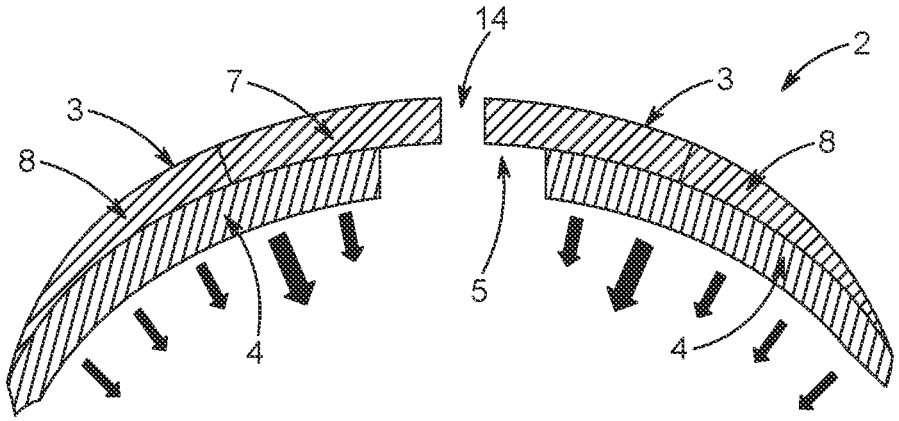
FIG. 13 shows a cross section of a tongue of a footwear, along a plane perpendicular to the anterior-posterior axis of the tongue, wherein the second portion is provided as a cavity, and furthermore holes are provided in the generally stiff layer.

FIG. 13 shows a cross section of a tongue (2) of a footwear, along the coronal plane, wherein the second portion (5) is provided as a cavity, and furthermore holes (14) are provided in the generally stiff layer (3). The second portion (of the inner padding layer) may be provided as a cavity and/or an air permeable material, that potentially extends towards the outside of the tongue/footwear. The second portion thereby provides an air passage between the footwear and the outside, for increased ventilation, in addition to temperature regulation by an increased blood flow. Alternatively, or additionally, an air passage may be provided by the holes. The ventilation through the holes (in the outer generally stiff layer) may thereby be in addition to ventilation through the air passage by extension of the cavity of the second portion (extension of said cavity in general outside the coronal plane). Thereby, the second portion does not need to form an air passage on its own, but an air passage may be formed together with one or more holes in the generally stiff layer. It should be noted, that although not shown in the figure, a support layer may be arranged outside the outer generally stiff layer.

Figure 14:
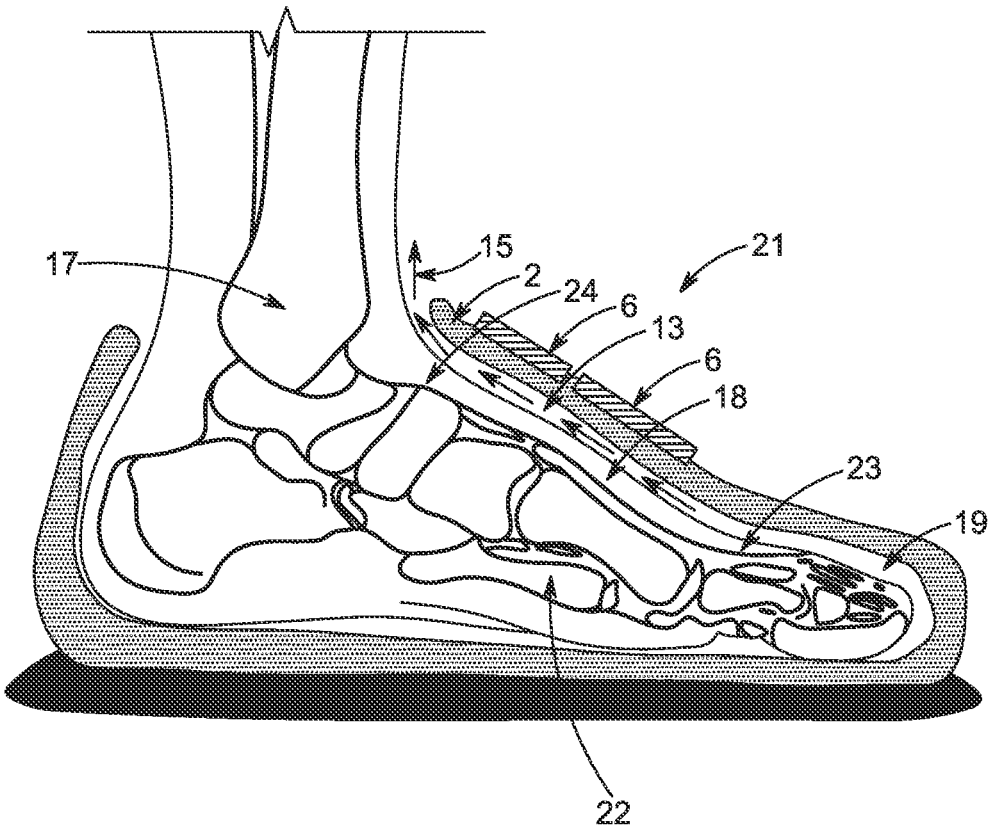
FIG. 14 shows a cross section along a plane parallel to the anterior-posterior plane of a foot within a footwear comprising a second portion provided in the form of a cavity, for increased ventilation.

FIG. 14 shows a foot (22) within a footwear (21) comprising a second portion (5) provided in the form of an air permeable material (or a cavity), wherein the second portion forms an air passage (13) between a toe section (19) of the footwear and the outside (15) of the footwear. A support layer (6) acts to maintain the overall shape of the tongue (2) of the footwear. Temperature regulation of the foot can be improved, both by allowing for increased blood flow, as the second portion covers the parts of the dorsal surface of a foot (18) wherein important blood vessels are close to the epidermal layer, and furthermore as the second portion forms an air passage between the toe section and the outside of the footwear, resulting in improved ventilation and thereby removal or warm and typically moist air. Air, typically warm, may thereby be ventilated from the toe section of a shoe (19) and along the dorsal surface of a foot, such as from the anterior part of a dorsal surface of the foot (23) to the anterior part of a dorsal surface of the foot (24).

Figure 15:
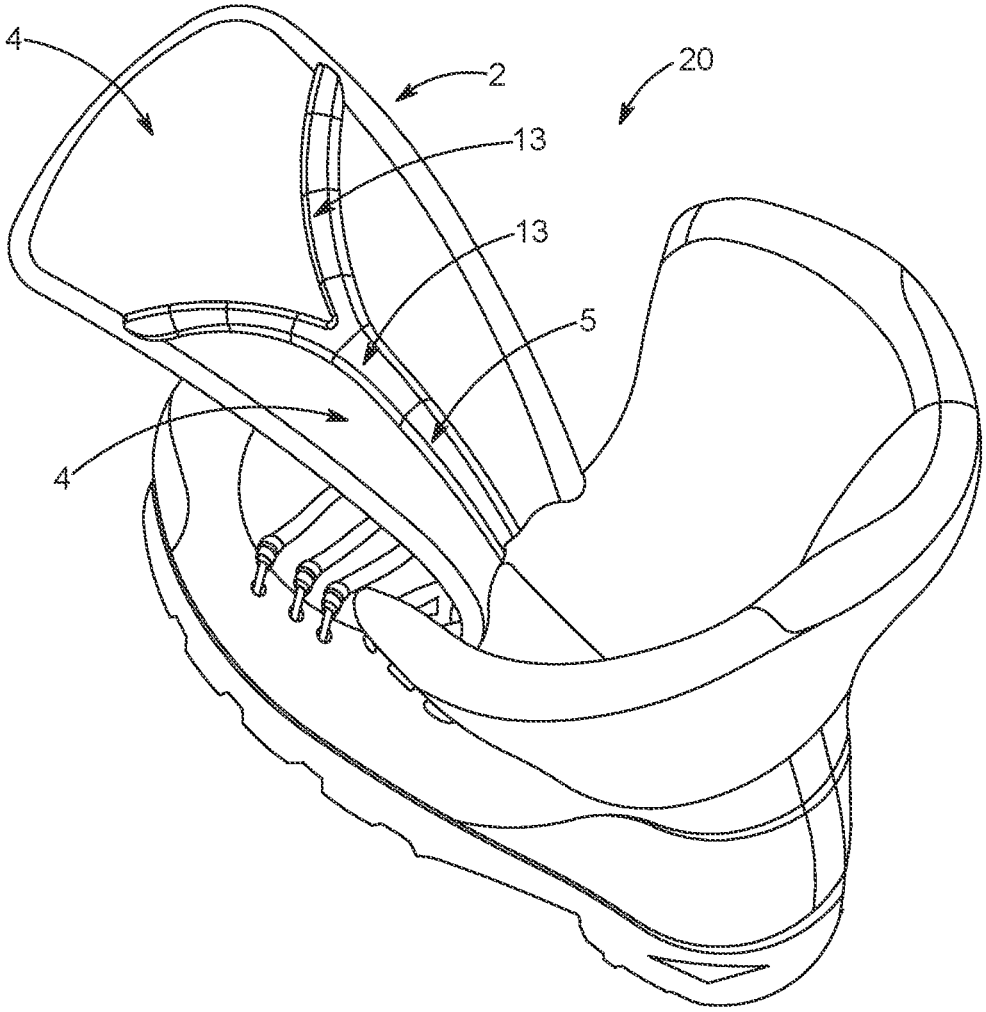
FIG. 15 shows a footwear wherein the second portion is provided in the form of a cavity, extending towards to outside of the footwear, for forming an air passage between the inside of the footwear and the outside of the footwear, when in use.

FIG. 15 shows a footwear, in the form of a hiking boot (20), wherein the second portion (5) of the tongue (2) is at least partially provided in the form of a cavity, extending towards the outside of the footwear. The cavity is arranged such that an air passage is formed between the inside of the footwear, such as a toe section, and the outside of the footwear, when in use. The air passage can be seen to be split up into two separate air passages extending towards the edges of the tongue, and thereby form an air canal between an inner part of the footwear, such as the tow section when in use, and the outside of the footwear. The arrangement of the first and second portion along the inner padding layer, such as when seen along a coronal cross section of the tongue, may not necessarily be constant. Instead, as can be seen in the figure, the second portion, here at least partially provided as a cavity, may be nearer the edges of the tongue, while the first portion is closer towards the center of the tongue, along the anterior-posterior axis of the tongue.

Figure 16:
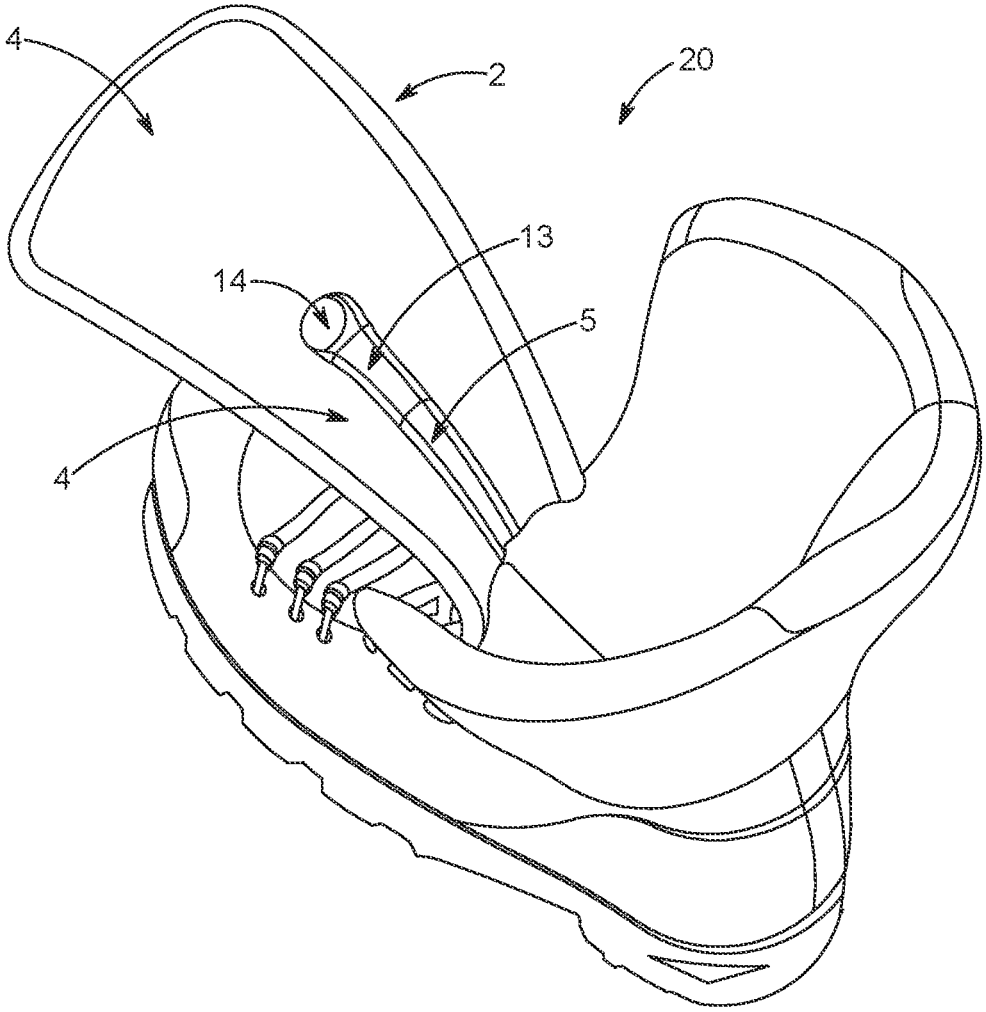
FIG. 16 shows a footwear wherein the second portion is provided in the form of a cavity, extending towards a hole in the outer generally stiff layer, for ventilation.

FIG. 16 shows a footwear, in the form of a hiking boot (20), wherein the second portion (5) of the tongue (2) is at least partially provided in the form of a cavity, extending along the anterior-posterior axis of the tongue of said footwear. The cavity is arranged such that an air passage is formed between the inside of the footwear, such as a toe section, and the outside of the footwear, when in use. The air passage further comprises one or more holes (14) in the outer generally stiff layer (only one hole shown in figure). The air passage formed by the provision of the second portion as a cavity does thereby not necessarily need to extend all the way towards an endpoint of the tongue. Instead, ventilation of the foot may be provided by movement of air in and out of one or more holes in the generally stiff layer. The one or more holes are preferably located towards the posterior part of the tongue. Thereby, an air passage is required for movement of air from a toe section of the footwear, when in use, to one or more holes, such that air can be exchanged.

Items

1. A liner for a ski boot, said liner comprising a tongue comprising:
   a. an outer generally stiff layer, said layer being substantially saddle-shaped and generally conforming to a dorsal surface of a foot;
   b. an inner padding layer providing contact to the dorsal surface of the foot, the inner padding layer having at least a first portion and a second portion, wherein the second portion is arranged to cover at least a part of a dorsalis pedis artery on the dorsal surface of the foot, wherein the second portion is softer than the first portion; and
   c. a support layer arranged outside the outer generally stiff layer, the support layer at least partially overlapping the second portion of the inner padding layer.

2. The liner according to item 1, wherein the second portion is configured to, at least partially, contact the dorsal surface where the dorsalis pedis artery is near the epidermal layer.

3. The liner according to any of the preceding items, wherein the second portion is arranged such that a smaller pressure is applied on the dorsal surface, where the dorsalis pedis artery is near the epidermal layer, than an average pressure applied by the first portion.

4. The liner according to any of the preceding items, wherein the second portion is made of a soft, insulating material, such that it provides climate control and/or comfort to the foot.

5. The liner according to any of the preceding items, wherein the second portion is arranged such that a smaller pressure is applied on the dorsal surface, where the deep peroneal nerve is near the epidermal layer, than an average pressure applied by the first portion.

6. The liner according to any of the preceding items, wherein the second portion is configured to have a symmetry axis substantially overlapping an anterior-posterior center axis of the dorsal surface when the tongue is arranged on the foot.

7. The liner according to any of the preceding items, wherein the second portion is configured to apply a lower pressure locally along an anterior-posterior center axis of the dorsal surface.

8. The liner according to any of the preceding items, wherein the first portion is configured to apply a higher pressure on the peripheral parts of the dorsal surface, along an anterior-posterior axis.

9. The liner according to any of the preceding items, wherein the first and second portion is configured to provide increased planar stability of the foot.

10. The liner according to any of the preceding items, wherein the total area of the support layer is larger than the total area of the second portion.

11. The liner according to any of the preceding items, wherein the total area of the support layer is between the total area of the second portion and the total area of the outer generally stiff layer.

12. The liner according to any of the preceding items, wherein the total area of the support layer is at least half the area of the second portion, preferably the same area as the second portion, more preferably 3 times the area of the second portion, most preferably 4 times the area of the second portion.

13. The liner according to any of the preceding items, wherein a material of the second portion is selected such that the pressure applied to the dorsal area, by the second portion, in a position mounted on the foot, is less than 100 kPa, preferentially less than 70 kPa, even more preferably less than 50 kPa, most preferably less than 30 kPa.

14. The liner according to any of the preceding items, wherein the material of the second portion is selected such that the pressure applied to the dorsal area, where dorsalis pedis artery is near the epidermal layer, by the second portion, in a position mounted on the foot, is less than 100 kPa, preferentially less than 70 kPa, even more preferably less than 50 kPa, most preferably less than 30 kPa.

15. The liner according to any of the preceding items, wherein a material of the first portion is selected such that the pressure applied to the foot by the first portion, in a position mounted on the foot, is at least 30 kPa, preferably 50 kPa, more preferably 70 kPa, even more preferably at least 100 kPa.

16. The liner according to any of the preceding items, wherein the support layer is made of a metal, such as steel.

17. The liner according to any of the preceding items, wherein the support layer is made of Kevlar, glass fiber or a synthetic material.

18. The liner according to any of the preceding items, wherein the second portion is made of a synthetic material, such as ethylene-vinyl acetate (EVA) or low-density polyethylene (LDPE).

19. The liner according to any of the preceding items, wherein the first portion is made of a synthetic material, such as ethylene-vinyl acetate (EVA) or low-density polyethylene (LDPE).

20. The liner according to any of the preceding items, wherein the generally stiff layer is made of a synthetic material, such as acrylonitrile butadiene styrene (ABS) or low-density polyethylene (LDPE).

21. The liner according to any of the preceding items, wherein the area of the second portion is between 1-20% of the area of the inner padding of the tongue, preferably 1-10%, most preferably 1-5%.

22. The liner according to any of the preceding items, wherein the tongue additionally is structured in such a way as to further make contact with the lower part of a leg.

23. A tongue for a footwear comprising:

a. an outer generally stiff layer, said layer being substantially saddle-shaped and generally conforming to a dorsal surface of a foot;

b. an inner padding layer providing contact to the dorsal surface of the foot, the inner padding layer having at least a first portion and a second portion, wherein the second portion is arranged to cover at least a part of a dorsalis pedis artery on the dorsal surface of the foot, and wherein the second portion is softer than the first portion; and c. a support layer arranged outside the outer generally stiff layer, the support layer at least partially overlapping the second portion of the inner padding layer.

24. A footwear, such as a sports shoe, preferably a liner of a ski boot, comprising a tongue according to any of items 1-1.

25. The footwear according to item 1, wherein the footwear is a ski boot or a cross-country ski boot or a telemark ski boot or an alpine ski boot or a free ride ski boot or a snowboard boot or a wakeboard boot or a water ski boot or an ice skating boot or touring skate boot or a hiking boot or a trail boot or a running shoe or a sports shoe, or a work shoe, or a boot, or a mountain boots or an orthopedic shoe or a shoe.

26. A liner for a ski boot, said liner comprising a tongue comprising:

a. an outer generally stiff layer, said layer being substantially saddle-shaped and generally conforming to a dorsal surface of a foot;

b. an inner padding layer providing contact to the dorsal surface of the foot, the inner padding layer having at least a first portion and a second portion, wherein the second portion is arranged to cover at least a part of a dorsalis pedis artery and/or a deep peroneal nerve on the dorsal surface of the foot, and wherein the second portion is softer than the first portion, and wherein the outer generally stiff layer has a first part and a second part wherein the second part has a thickness of at least 3 mm, more preferably 4 mm, even more preferably, 5 mm, most preferably 10 mm, over an area of the second portion.

27. The liner for a ski boot according to item 1, comprising a tongue according to any of item 1-1.

28. The liner for a ski boot according any of the previous items, wherein the second part of the generally stiff layer is on average thicker than the first part of the generally stiff layer.

The invention claimed is:

1. A tongue for a footwear comprising:

an outer generally stiff layer, said layer being substantially saddle-shaped and generally conforming to a dorsal surface of a foot;

an inner padding layer providing contact to the dorsal surface of the foot, the inner padding layer having at least a first portion and a second portion;

wherein the second portion is arranged to cover at least a part of a dorsalis pedis artery and/or a deep peroneal nerve on the dorsal surface of the foot, and wherein an entirety of the second portion is a material that is softer than an entirety of the first portion;

and wherein the outer generally stiff layer has a first part and a second part wherein the second part has a thickness of at least 3 mm, or 4 mm, or 5 mm, or 10 mm, over an area of the second portion, and wherein the second portion is an area that is between 1-20% of the area of the inner padding of the tongue, and wherein the first portion is the remainder of the area of the inner padding that is at least 80% of the area of the inner padding of the tongue.

2. The tongue according to claim 1, wherein the second portion is configured to, at least partially, contact the dorsal surface where the dorsalis pedis artery is near an epidermal layer of the foot.

3. The tongue according to claim 1, wherein the second portion is arranged such that a smaller pressure is applied on the dorsal surface, where the dorsalis pedis artery is near an epidermal layer, than an average pressure applied by the first portion.

4. The tongue according to claim 1, wherein the second portion is arranged such that a smaller pressure is applied on the dorsal surface, where a deep peroneal nerve is near an epidermal layer, than an average pressure applied by the first portion.

5. The tongue according to claim 1, wherein:

the second portion is made of a soft, insulating material.

6. The tongue according to claim 1, wherein the second portion has a symmetry axis substantially overlapping an anterior-posterior center axis of the dorsal surface when the tongue is arranged on the foot.

7. The tongue according to claim 1, wherein:

the second portion is configured to apply a lower pressure locally along an anterior-posterior center axis of the dorsal surface compared to a pressure applied, by the first portion, on peripheral parts of the dorsal surface.

8. The tongue according to claim 1, wherein the first and second portion are configured to provide increased planar stability of the foot.

9. The tongue according to claim 1, wherein:

a material of the second portion is selected such that a pressure applied to the dorsal area, by the second portion, in a position mounted on the foot, is less than 100 kPa, or less than 70 kPa, or less than 50 kPa, or less than 30 kPa; and/or the material of the second portion is selected such that a pressure applied to the dorsal area, where a dorsalis pedis artery is near an epidermal layer, by the second portion, in a position mounted on the foot, is less than 100 kPa, or less than 70 kPa, or less than 50 kPa, or less than 30 kPa.

10. The tongue according to claim 1, wherein a material of the first portion is selected such that a pressure applied to the foot by the first portion, in a position mounted on the foot, is at least 30 kPa, or 50 kPa, or 70 kPa, or at least 100 kPa.

11. The tongue according to claim 1, wherein:

the second portion is made of a synthetic material, or ethylene-vinyl acetate (EVA) or low-density polyethylene (LDPE); and/or the first portion is made of a synthetic material, or ethylene-vinyl acetate (EVA) or low-density polyethylene (LDPE)); and/or the generally stiff layer is made of a synthetic material, or acrylonitrile butadiene styrene (ABS) or low-density polyethylene (LDPE).

12. The tongue according to claim 1, wherein the area of the second portion is between 1-10% of the area of the inner padding of the tongue.

13. The tongue according to claim 1, wherein the tongue additionally is structured in such a way as to further make contact with a lower part of a leg.

14. A footwear comprising a tongue according to claim 1.

15. The footwear according to claim 14, wherein the footwear is a ski boot or a cross-country ski boot or a telemark ski boot or an alpine ski boot or a free ride ski boot or a snowboard boot or a wakeboard boot or a water ski boot or an ice skating boot or touring skate boot or a hiking boot or a trail boot or a running shoe or a sports shoe, or a work shoe, or a boot, or a mountain boot or an orthopedic shoe or a shoe.

16. The tongue according to claim 1, wherein the second part of the generally stiff layer is on average thicker than the first part of the generally stiff layer.

17. The tongue according to claim 1, wherein the area of the second portion is between 1-5% of the area of the inner padding of the tongue.

* * * * *